US008020784B2

(12) United States Patent
Baumann et al.

(10) Patent No.: US 8,020,784 B2
(45) Date of Patent: Sep. 20, 2011

(54) COATING MATERIAL SUPPLY INSTALLATION AND ASSOCIATED OPERATING PROCEDURE

(75) Inventors: Michael Baumann, Flein (DE); Frank Herre, Oberriexingen (DE); Herbert Martin, Weinstadt (DE); Rainer Melcher, Oberstenfeld (DE); Manfred Michelfelder, Höfigheim (DE); Bernhard Seiz, Lauffen (DE); Richard Ostin, Farmington, MI (US); Robert F. Heldt, Oxford, MI (US)

(73) Assignee: Durr Systems Inc., Auburn Hills, MI (US)

( * ) Notice: Subject to any disclaimer, the term of this patent is extended or adjusted under 35 U.S.C. 154(b) by 1324 days.

(21) Appl. No.: 11/544,515

(22) Filed: Oct. 6, 2006

(65) Prior Publication Data

US 2007/0082143 A1 Apr. 12, 2007

Related U.S. Application Data

(60) Provisional application No. 60/791,164, filed on Apr. 11, 2006.

(30) Foreign Application Priority Data

Oct. 7, 2005 (DE) ..... 10 2005 048 223
Dec. 20, 2005 (DE) ..... 10 2005 019 876
Dec. 20, 2005 (DE) ..... 10 2005 060 959

(51) Int. Cl.
*B05B 5/025* (2006.01)

(52) U.S. Cl. ..... 239/3; 239/71; 239/708; 141/91; 141/98; 901/43

(58) Field of Classification Search ..... 141/18, 141/27, 91, 95, 98, 104, 2; 239/71, 690, 239/708, 3; 901/43
See application file for complete search history.

(56) References Cited

U.S. PATENT DOCUMENTS 4,020,866 A 5/1977 Wiggins
4,313,475 A 2/1982 Wiggins
4,614,300 A * 9/1986 Falcoff ..... 239/71
(Continued)

FOREIGN PATENT DOCUMENTS

DE 3644536 C1 11/1987
(Continued)

OTHER PUBLICATIONS

International Search Report EP1772194A3, Dated Aug. 8, 2008.

*Primary Examiner* — Gregory Huson
*Assistant Examiner* — Nicolas A Arnett
(74) *Attorney, Agent, or Firm* — Rader Fishman & Grauer PLLC

(57) ABSTRACT

A coating material supply device is disclosed, such as for a paint facility. An exemplary coating material supply device may include a coating material reservoir and a coating material meter. During application of coating material, the coating material reservoir may be at ground potential and may be located upstream from the coating material meter, which may be at a high-voltage potential. The reservoir may be connected via an insulating path to the coating material meter. The coating material meter may be at ground potential when the coating material reservoir supplies coating material to the coating material meter. Before the coating material meter is returned to a high-voltage potential for continued application of coating material, the insulating path may be emptied to insulate the coating material meter from the coating material reservoir.

10 Claims, 17 Drawing Sheets

U.S. PATENT DOCUMENTS

| | | | | |
|---|---|---|---|---|
| 4,993,644 | A | 2/1991 | Klemm | |
| 5,102,045 | A * | 4/1992 | Diana | 239/3 |
| 5,197,676 | A | 3/1993 | Konieczynski et al. | |
| 5,364,035 | A | 11/1994 | Ma et al. | |
| 5,647,542 | A * | 7/1997 | Diana | 239/690 |
| 6,253,800 | B1 * | 7/2001 | Yoshida et al. | 141/18 |
| 6,401,768 | B2 * | 6/2002 | Lichte et al. | 141/2 |
| 6,612,345 | B1 * | 9/2003 | Hosoda et al. | 141/20.5 |
| 6,705,361 | B2 * | 3/2004 | Niederquell et al. | 141/198 |
| 6,896,010 | B2 * | 5/2005 | Cebola et al. | 141/2 |
| 7,759,449 | B2 * | 7/2010 | Nichols et al. | 528/272 |
| 7,793,858 | B2 * | 9/2010 | Heldt et al. | 239/123 |
| 2004/0115360 | A1 * | 6/2004 | Clifford et al. | 427/421 |
| 2004/0216804 | A1 * | 11/2004 | Luehrsen et al. | 141/2 |
| 2007/0090128 | A1 * | 4/2007 | Martin | 222/135 |

FOREIGN PATENT DOCUMENTS

| | | | |
|---|---|---|---|
| DE | 69001744 | T2 | 11/1993 |
| DE | 69109823 | T2 | 11/1995 |
| DE | 19524853 | A1 | 1/1996 |
| DE | 69109949 | | 2/1996 |
| DE | 19961270 | | 7/1997 |
| DE | 20118531 | U1 | 1/2003 |
| DE | 69714886 | | 4/2003 |
| DE | 69917411 | | 7/2005 |
| DE | 102004015117 | A1 | 10/2005 |
| DE | 102005048223 | A1 | 4/2007 |
| DE | 102005060959 | A1 | 4/2007 |
| EP | 0428435 | A1 | 5/1991 |
| EP | 0455106 | A1 | 11/1991 |
| EP | 0455110 | A1 | 11/1991 |
| EP | 0467626 | A1 | 1/1992 |
| EP | 0487378 | A1 | 5/1992 |
| EP | 1108474 | A2 | 6/2001 |
| EP | 1 384 885 | A1 | 1/2004 |
| EP | 1475161 | A2 | 11/2004 |
| EP | 1772194 | A2 | 4/2007 |
| GB | 2282085 | A | 3/1995 |
| JP | 6154666 | A | 6/1994 |

* cited by examiner

COATING MATERIAL SUPPLY INSTALLATION AND ASSOCIATED OPERATING PROCEDURE

RELATED APPLICATION

This application claims priority to U.S. Provisional patent Application Ser. No. 60/791,164 filed Apr. 11, 2006, which application is incorporated herein in its entirety by reference. This application also claims priority to German application no. 10 2005 048 223.6 filed Oct. 7, 2005, no. 10 2005 060 959.7 filed Dec. 20, 2005 and no. 20 2005 019 876.5 filed Dec. 20, 2005, each of which is also incorporated in its entirety by reference.

FIELD OF THE INVENTION

The present invention relates to a coating means supply device and an associated operating method for the same.

BACKGROUND

Multi-axis painting robots with a rotational atomizer as the application equipment can be used, for example, for painting automobile body parts. Such robots are known in the art (see, for example, World Intellectual Property Organization publication WO 2004/0374 36 A1). A piston meter, which supplies paint to a rotational atomizer, is mounted on the arm of the painting robot and in operation is connected to a high-voltage potential, so that the paint applied by the rotational atomizer is electrically charged. This results in good transfer efficiency with respect to electrically grounded vehicle body parts or other components to be painted. Further, a color changer, located on the same robot arm as the piston meter, is supplied through numerous color lines with paints of different colors. The color changer allows the selection of the desired color and supplies the piston meter with the appropriate paint. In operation, the color changer is connected to an electrical ground potential so that the numerous color lines do not have to be electrically insulated. The connection between the color changer and the piston meter is provided by an insulating hose that ensures electrical insulation between the color changer connected to ground potential, and the piston meter connected to high-voltage potential. The separation of electrical potential between the color changer and the piston meter is achieved by purging and cleaning the insulating hose.

There are disadvantages to this known painting robot. These disadvantages include the relatively long duration of the color change, which results in a slowing down of the painting process particularly with frequent color changes. These disadvantages also include the fact that the piston meter has to be filled again, even without a color change, when the entire charge capacity of the piston metering pump has been applied by the rotational atomizer. The recharging of the piston meter by the color changer is similarly relatively time-consuming, which slows down the painting process.

BRIEF SUMMARY OF THE INVENTION

According to teachings of the invention herein, the coating means meter (e.g., a piston meter) is not filled directly from the color changer but indirectly through an interposed coating means reservoir. This provides the opportunity to fill the coating means reservoir with coating means while painting is in progress and not during the times for color changes, which contributes to reducing the color change times. The continuous charging of the coating means reservoir while painting is in progress also provides the advantage that, because of the time available for charging, relatively small paint flow quantities in the supply lines (e.g., color circulation lines and special color supply) are adequate so that the appropriate lines can have a smaller line cross-section, thereby reducing installation costs.

The coating means meter can be connected to a high-voltage potential while the coating means reservoir is connected to a neutral ground (preferably ground potential). The coating means reservoir is connected through an insulating path to the coating means meter. In one embodiment of the invention the insulating path can consist of an insulating hose in which a termination piston or slug can be moved to clean the insulating hose and thus achieve the desired insulating effect.

In another embodiment of the invention the connection between the coatings means reservoir and the coating means meter is not made permanently by an insulating hose but by a detachable docking interface. When the coating means reservoir is filled it is connected to a neutral ground. The coating means reservoir is then separated from the coating means line when filling the coating means meter and connected to the docking interface (when the coating means reservoir is then on the same high-voltage potential as the coating means meter). The coating means reservoir can be moved in this embodiment of the invention between the high-voltage potential of the coating means meter and the ground potential of the coating means supply line.

In yet another embodiment of the invention the coating means reservoir has an adjustable storage capacity where the storage capacity can be adjusted, for example, by a piston operated by compressed air. During a color change this provides the opportunity of pushing the new coating means remaining in the coating means reservoir (after the charging of the coating means meter) out of the coating means reservoir back into the coating means line. This can also be described as "reflow." In this embodiment the consumption of coating means is reduced by this "reflow", since the new coating means remaining in the coating means reservoir (after charging the coating means meter) can be used further. Also the cleaning of the coating means reservoir is made easier so that less purging solvent is required.

The coating means meter can be a piston meter, as described, for example, in publication WO 2004/037436 A1 mentioned above. The invention is, however, not restricted to piston meters with respect to the type of coating means meter but can be implemented with other types of meter.

The coating means reservoir can be a cylinder with a storage piston located movably in the cylinder. The storage piston can be driven, for example, by an electric motor, hydraulically or pneumatically. The position of the storage piston determines the storage capacity of the coating means reservoir.

In an embodiment of the invention, the coating means meter and the coating means reservoir are integrated in a common cylinder. In an aspect of this embodiment, the common cylinder is divided into two partial cylinders by a dividing wall located centrally in the cylinder. The metering piston for the coating means meter can be moved in one part of the cylinder while the storage piston for the coating means reservoir can be moved in the other part of the cylinder. The metering piston can be driven by a piston rod, while the storage piston can be driven pneumatically.

In another aspect of this embodiment with a common cylinder for the coating means meter and the coating means reservoir there is, in contrast, no dividing wall located in the common cylinder. The storage chamber of the coating means reservoir is located on the back side of the metering piston.

The storage piston is located movably in this storage chamber of the common cylinder. The storage piston drive can be pneumatic. If it is, the pneumatic pressure to drive the storage piston however acts not only on the storage piston but also on the back side of the metering piston so that the drive for the metering piston can be sufficiently rigid mechanically and thus be accomplished by a piston rod.

While embodiments of the invention are suitable for the application of water-borne paint, the invention is not restricted to water-borne paint with respect to the coating means to be applied. The invention can be implemented with other types of coating means.

Purging of the coating means reservoir, the coating means meter and the application equipment can take place through a single purge circuit.

The invention further comprises not only the previously described coating means supply device, but also a complete painting robot having such a coating means supply device. In this case the coating means meter and the coating means reservoir can be located with, in, or on one of several robot arms of the painting robot.

Finally, associated operating methods are described herein.

Other advantageous developments of the invention are explained in more detail in what follows in conjunction with the description of embodiments of the invention with reference to the figures.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS OF THE INVENTION

In what follows, the embodiment of a coating means supply device shown in FIG. 1 will be described first. This coasting supply means supply device can, for example, be located on a robot arm of a painting robot. A painting robot with a conventional coating means supply device so placed is known within the art (see, for instance, publication WO 2004/037436 mentioned above). Therefore the construction and the operation of the painting robot with a conventional coating means supply device and of the other components will not be repeated here.

Figure 1:
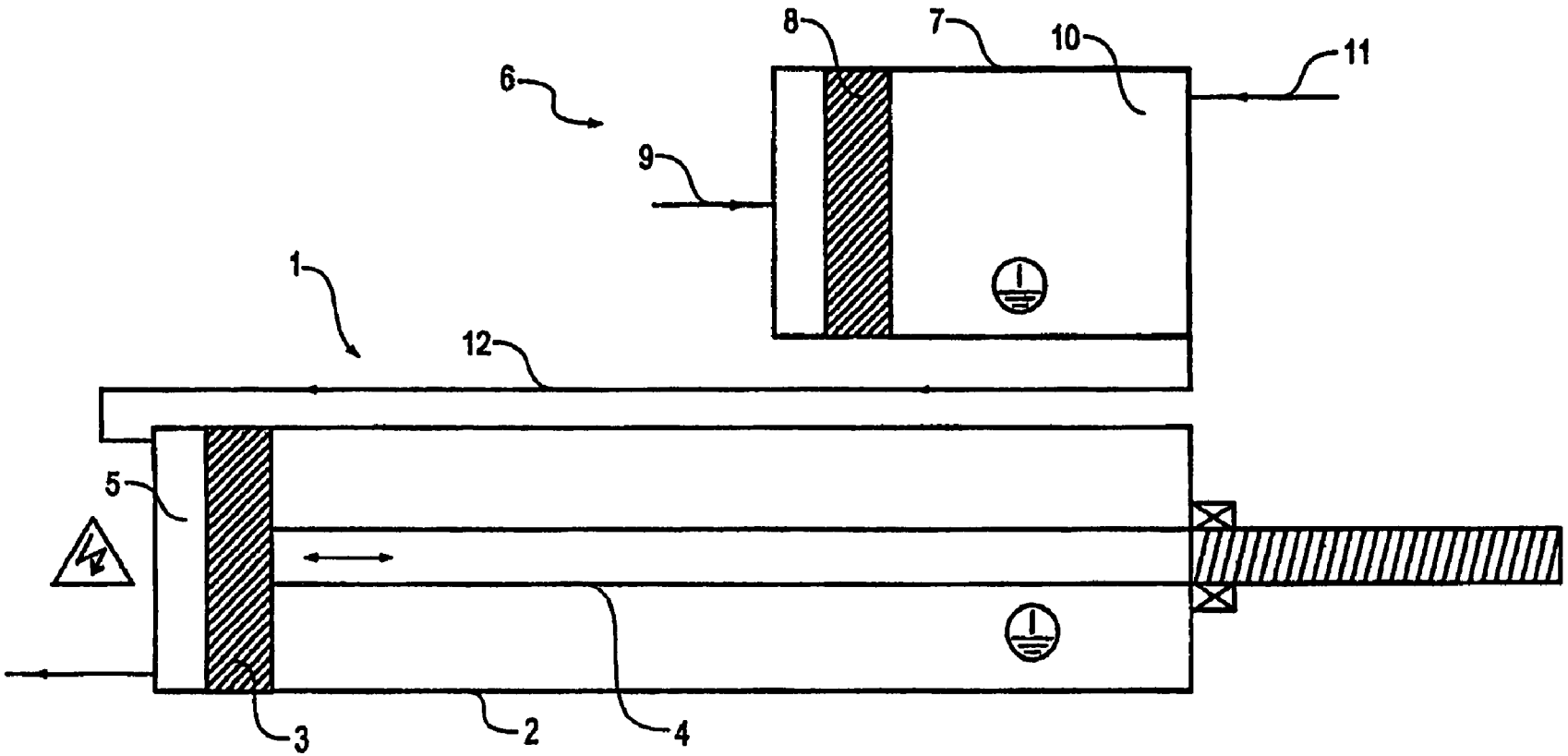
FIG. 1 shows a simplified representation of a coating means supply device for a painting robot, wherein a coating means reservoir is connected to a coating means meter through an insulating path.

The coating means supply device shown in FIG. 1 has a coating means meter 1, which in FIG. 1 is a piston meter. The coating means meter 1 has a cylinder 2 and metering piston 3 moveable in the direction of the arrow. The metering piston 3 is driven mechanically by a piston rod 4, which in turn can be driven by an electric motor, pneumatically or hydraulically. In the cylinder 2 of the coating means meter 1 there is a metering chamber 5 on the front side of the metering piston 3. The metering chamber 5 is adjustable by displacing the metering piston 3 in the cylinder 2. In operation, the metering chamber 5 with the coating means present in it (e.g., water-borne paint) is connected to a high-voltage potential, as indicated by the high-voltage symbol. The coating means dispensed by the coating means supply device is also under a high-voltage potential that contributes to good transfer efficiency in electrostatic painting. In contrast, the side of the piston 2 and of the piston rod 4 lying opposite the metering chamber 5 is at ground potential, similarly symbolized by the ground sign displayed. To separate the electrical potential, the cylinder 2 and the piston rod 4 consist of an electrically insulating material. On the other hand, the material of the cylinder 2 and the push rod 4 must be sufficiently rigid to achieve adequate metering accuracy. Additional details regarding the materials and design details for separation of the potential can be had by reference to, for example, in German publication DE 102 33 633 A1, which is incorporated by reference so that the content of this publication with respect to the construction and operation of the coating means metering device 1 of the present invention can be ascribed in full to the present description.

Furthermore, the coating means supply device shown in FIG. 1 has a coating means reservoir 6 consisting essentially of a cylinder 7 and a storage piston 8 movable in the cylinder. The storage piston 8 can be driven pneumatically over a compressed air line 9 and thus encloses an adjustable storage chamber 10 in the cylinder 7. The entire coating means reservoir 6 is located at ground potential, as shown symbolically by the ground sign.

The coating means reservoir 6 is supplied by a coating means supply line 11, which opens into the storage chamber 10 and comes from, for example, a conventional color changer. In addition, an insulating hose 12 branches out from the storage chamber 10 of the coating means reservoir 6 and opens into the metering chamber 5 of the coating means meter 1. The insulating hose 12, when it has been emptied and flushed, electrically insulates the coating means reservoir 6 from the coating means meter 1. The basic function of an insulating hose 12 is known within the field (see again, for instance, publication WO 2004/037436). Therefore the complete construction and operation of the insulating hose 12 will not be repeated here.

The insulating hose 12 should have a greater cross-section than the coating supply line 11 so that the coating means meter 1 can be charged as quickly as possible from the coating means reservoir, as will be described in more detail below. The smaller line cross-section of the coating means supply line 11 is beneficial since the charging of the coating means reservoir 6 takes place during painting. Hence, sufficient time is available for the charging of the coating means reservoir 6.

Since smaller lines can be used, the reduced line cross-section of the coating means supply line 11 has the advantage of lower costs.

It should be mentioned that additional components can be located in front of and behind the coating means reservoir 6 and the coating means meter 1, for example regulatable valves, which are not shown in the drawing for the sake of simplicity.

Figure 2A:
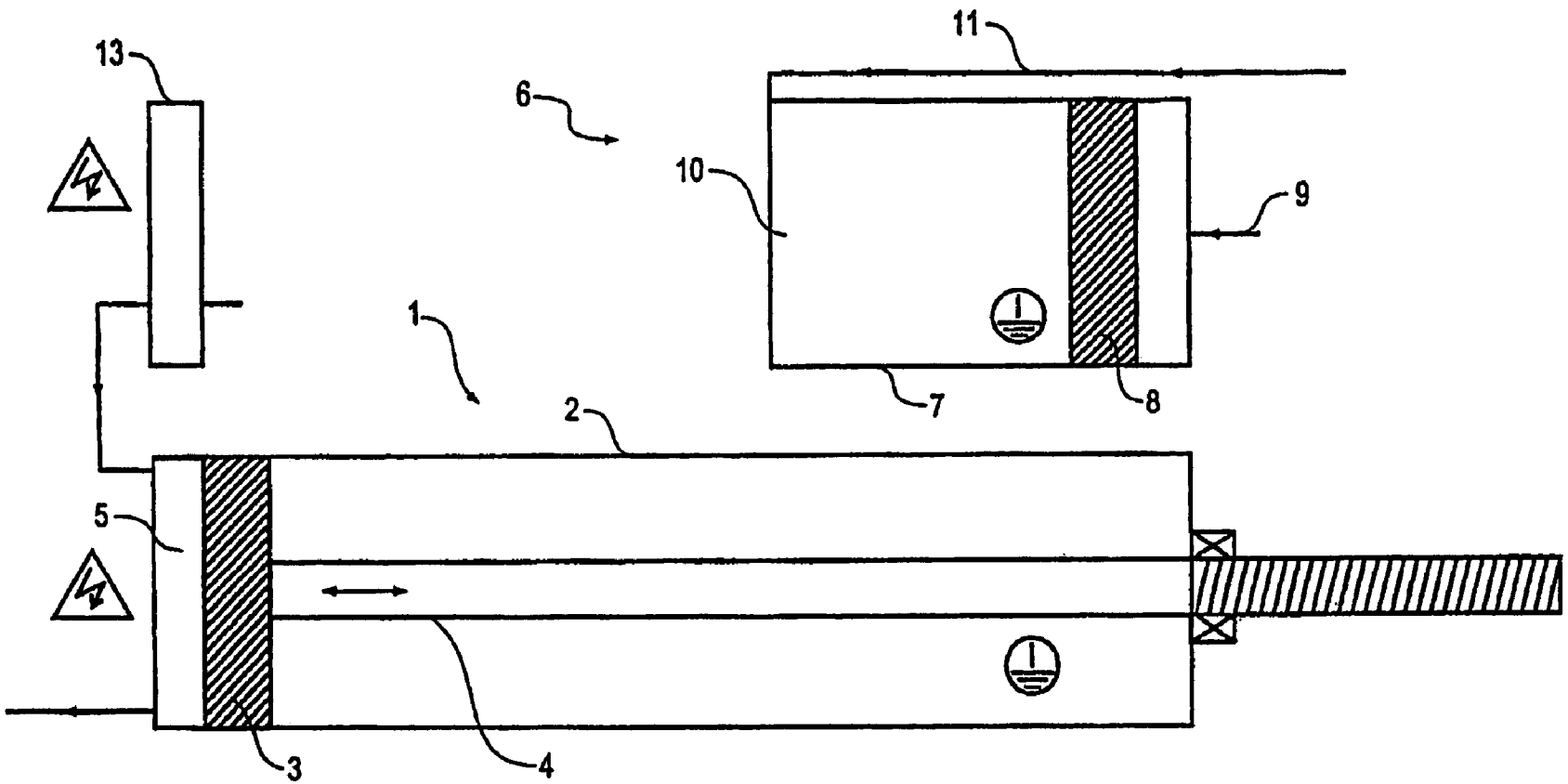
FIGS. 2A and 2B show an embodiment of a coating means supply device in which the coating means reservoir can be moved between a ground potential and a high-voltage potential and is connected temporarily to the coating means meter through a docking interface.
Figure 2B:
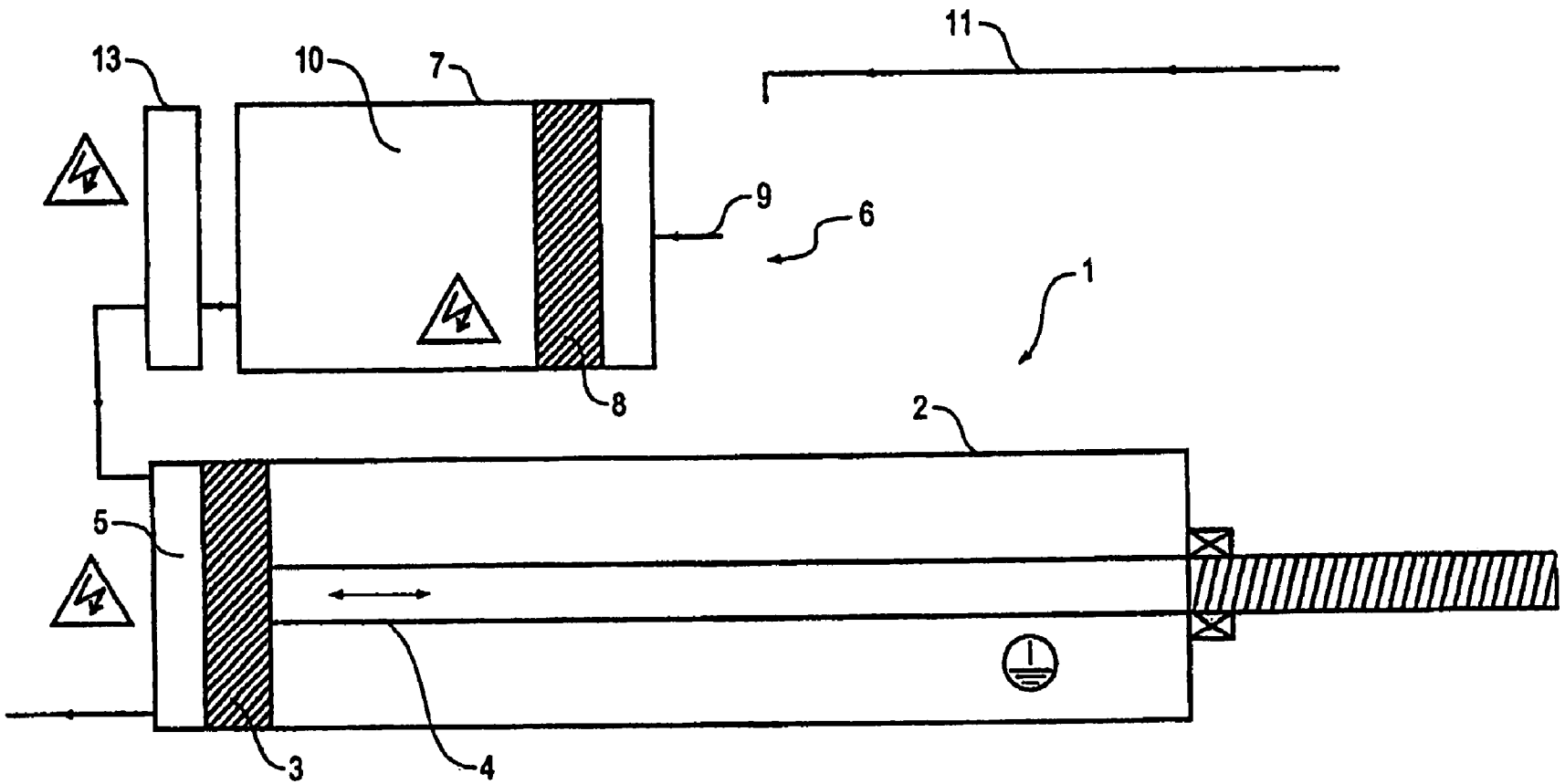

FIGS. 2A and 2B show an alternative embodiment of a coating means supply device. One feature of this embodiment is that the coating means reservoir 6 is not permanently connected to the coating means meter through the insulating hose 12. Instead, the coating means reservoir 6 can be moved between two positions, which are shown in FIGS. 2A and 2B.

In the position shown in FIG. 2A, the coating means reservoir 6 is connected to the coating means supply line 11 but is separated from the coating means meter 1 and lies at an electrical ground potential. In this position the coating means reservoir 6 is filled via the coating means supply line 11.

In the position shown in FIG. 2B in contrast, the coating means reservoir 6 is connected to the coating means meter 1 through a docking interface 13, but is separated from the coating means supply line 11. The coating means reservoir 6 thus lies at the same high-voltage potential as the coating means meter 1. In this position the coating means is filled from the coating means reservoir 6 into the coating means metering device 1.

For a color change, the coating means 6 reservoir is first filled via the coating means supply 11 with the new coating means (e.g., water-borne paint) while the coating means reservoir 6 is separated from the docking interface 13, as shown in FIG. 2A. During this filling of the coating means reservoir 6, the coating means meter 1 can continue to meter the old coating means so that it is not necessary to interrupt the painting process to fill the coating means reservoir 6. Hence, sufficient time is available for the filling process.

After the filling of the coating means reservoir 6, the coating means reservoir is then connected to the docking interface 13 as shown in FIG. 2B. After the connection to the docking interface 13 is made, the new coating means contained in the storage chamber 7 can be transferred into the metering chamber 5 of the coating means meter 1.

Figure 3:
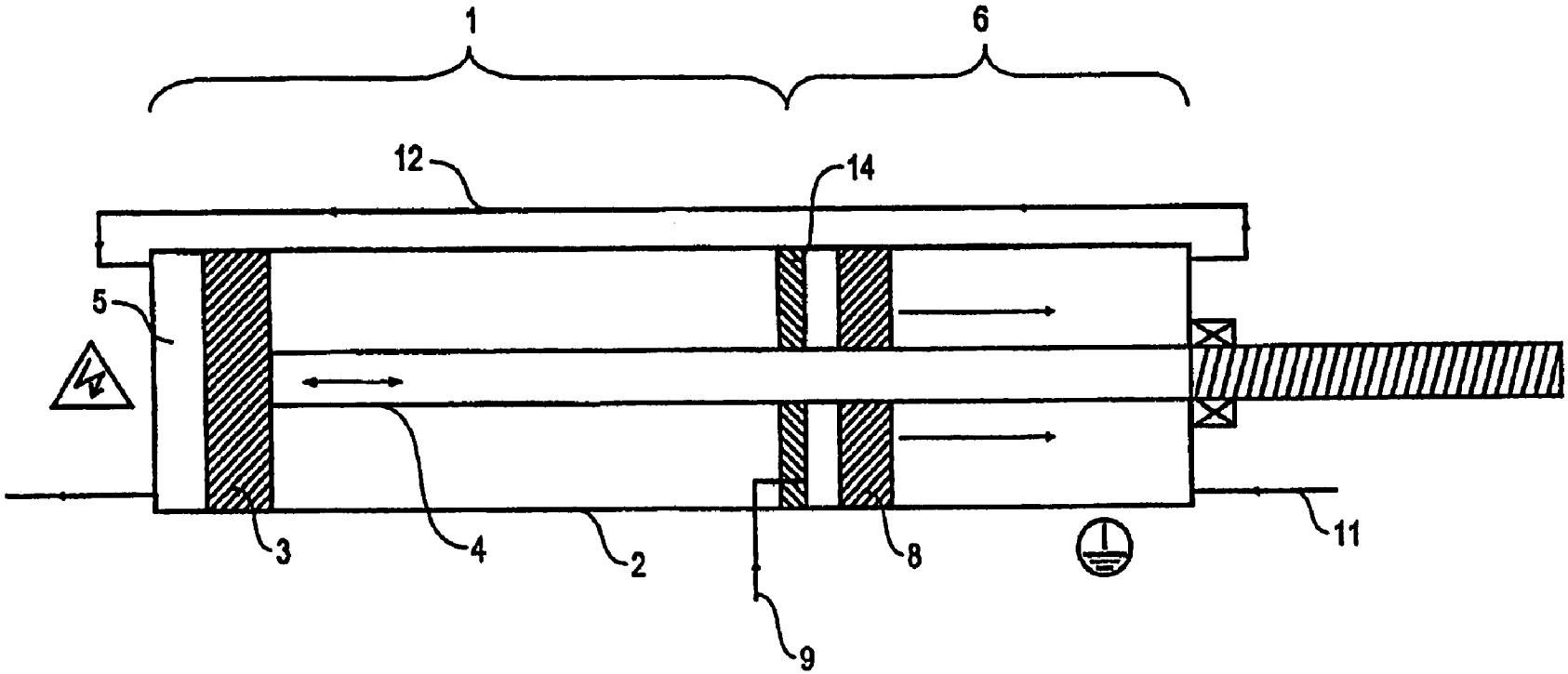
FIG. 3 shows another embodiment of a coating means supply device in which the coating means reservoir is integrated with the coating means meter in a common cylinder and a dividing wall is located in the common cylinder.

FIG. 3 shows a further embodiment of a coating means supply device in accordance with teachings herein. One feature of this embodiment is that the coating means reservoir 6 is integrated into the cylinder 2 of the coating means meter 1 on the back side of the metering piston 3. A dividing wall 14 is located in the cylinder 2, which wall 14 divides the cylinder 2 into two partial cylinders. In the partial cylinder on the right in the drawing the storage piston 8 can be moved by operation of compressed air.

Figure 4:
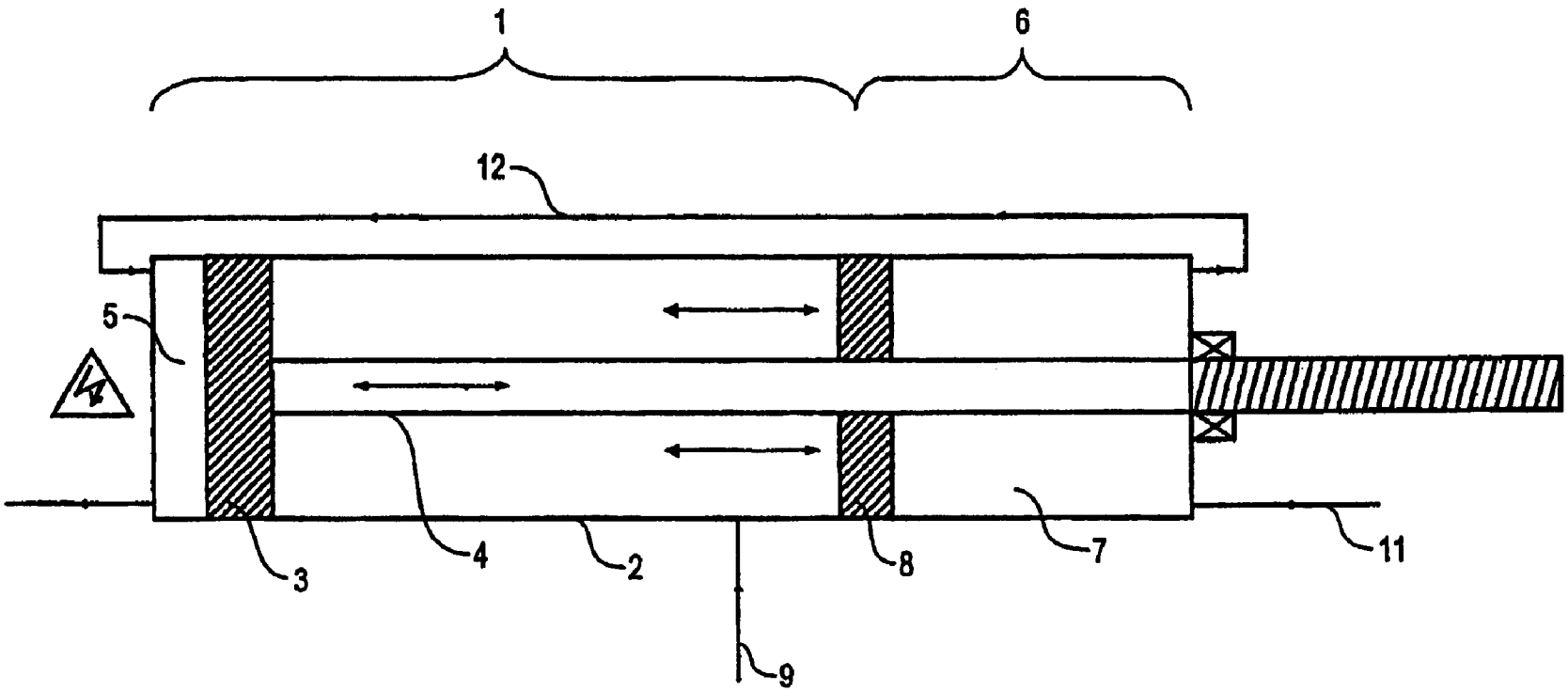
FIG. 4 shows a variation of the embodiment from FIG. 3 without a dividing wall in the common cylinder.

FIG. 4 shows a variation of the embodiment from FIG. 3. One feature of this embodiment is that the dividing wall 14 from the FIG. 3 embodiment, used to separate the two partial cylinders, is not present. The compressed air to drive the storage piston 8 acts also on the back side of the metering piston 3, which presupposes a sufficiently rigid mechanical drive for the metering piston 3.

FIGS. 5A to 5J show a painting facility with coating means supply device in accordance with embodiments of the invention in various phases of a color change, where the sequence of the color change is shown in the flow chart in FIG. 6 and as described next. The painting facility shown in FIGS. 5A to 5J has the coating means meter 1 described previously with reference to FIG. 1.

On the input side, the coating means reservoir 6 is connected through a valve array 15 to a color changer 16. On the output side, the coating means meter 1 is connected via a further valve array 17 to a rotational atomizer 18. A return line 19 leads from the rotational atomizer 18 through which the remaining coating means can be purged. An additional return line 20 leads from the valve array 15 where left over coating means can likewise be removed through the return line 20.

In what follows, the individual phases shown in FIGS. 5A to 5J during a color change are described where the lines carrying fluid are shown solid in the drawings.

Figure 5A:
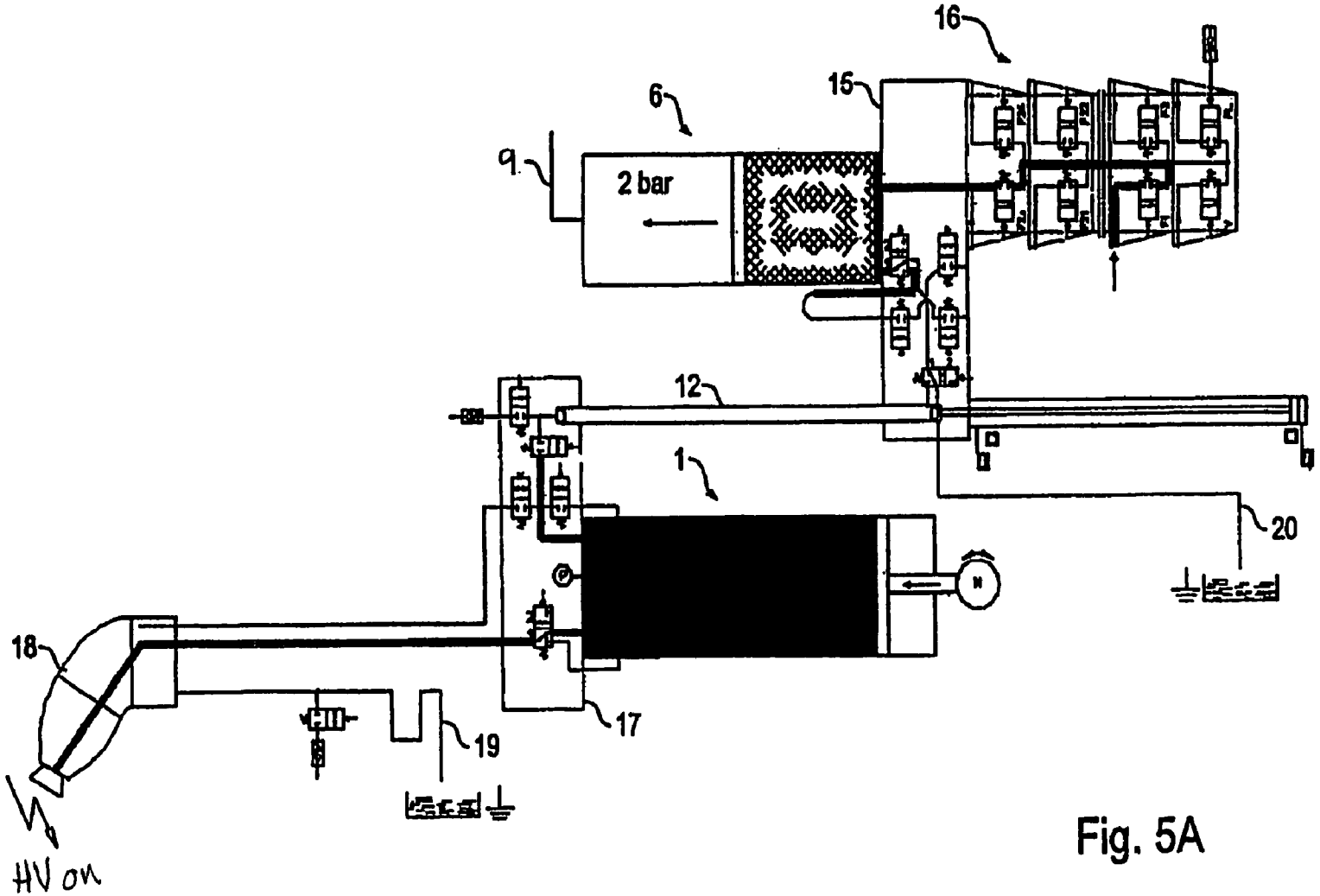
FIGS. 5A-5J show a painting facility with a color changer, a coating means reservoir, an insulating path, a coating means meter and a rotational atomizer, where different phases are shown during a color change.
Figure 6:
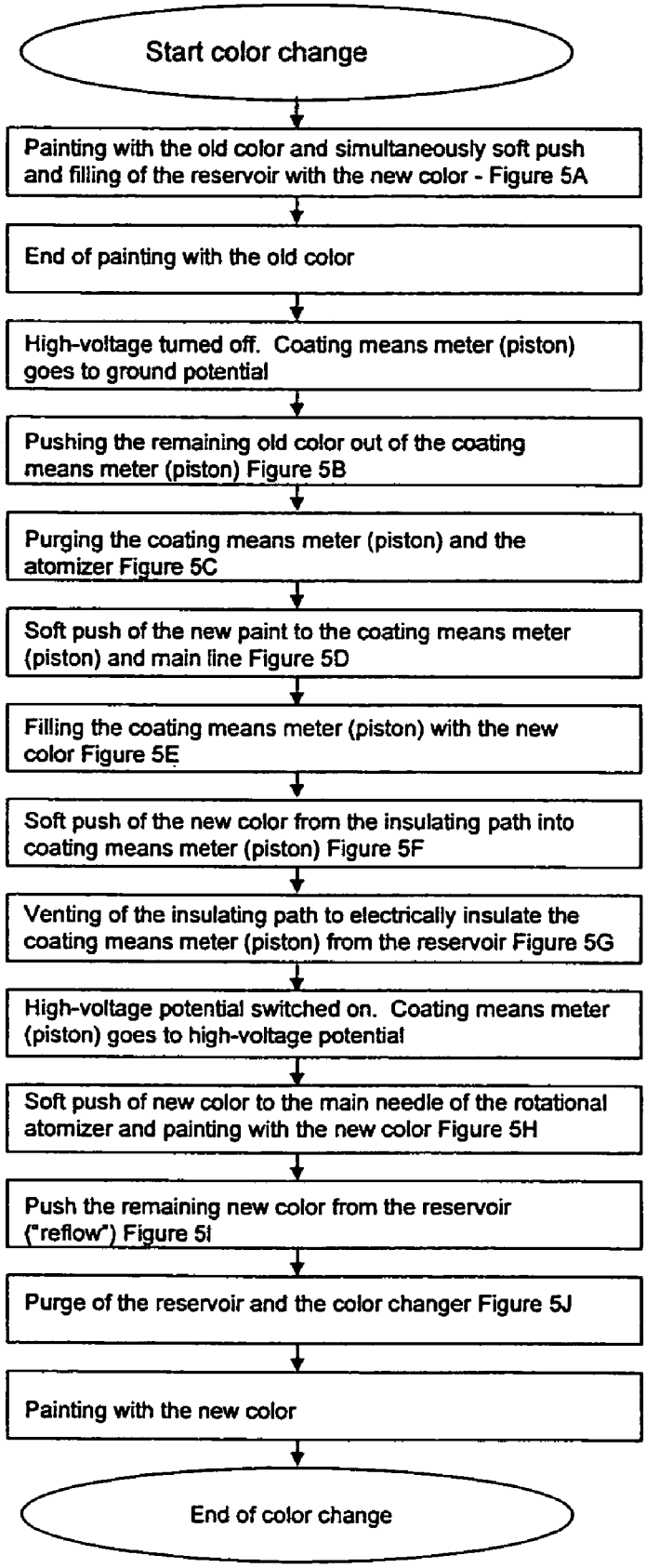
FIG. 6 is a flow chart to illustrate the different phases during a color change shown in FIGS. 5A-5J.

FIG. 5A initially shows normal painting operation when the coating means meter 1 is still filled with the old coating means metered to the rotational atomizer 18. The rotational atomizer 18 and the coating means meter 1 are at high-voltage potential to permit electrostatic painting of parts. To electrically insulate the coating means meter 1 from the coating means reservoir 6, the insulating hose 12 is then cleaned and emptied, which causes a separation of potential. The coating means reservoir 6 is initially still empty, where only a relatively low pressure of 2 bars is applied to the storage piston 8 through the compressed air line 9.

Figure 5B:
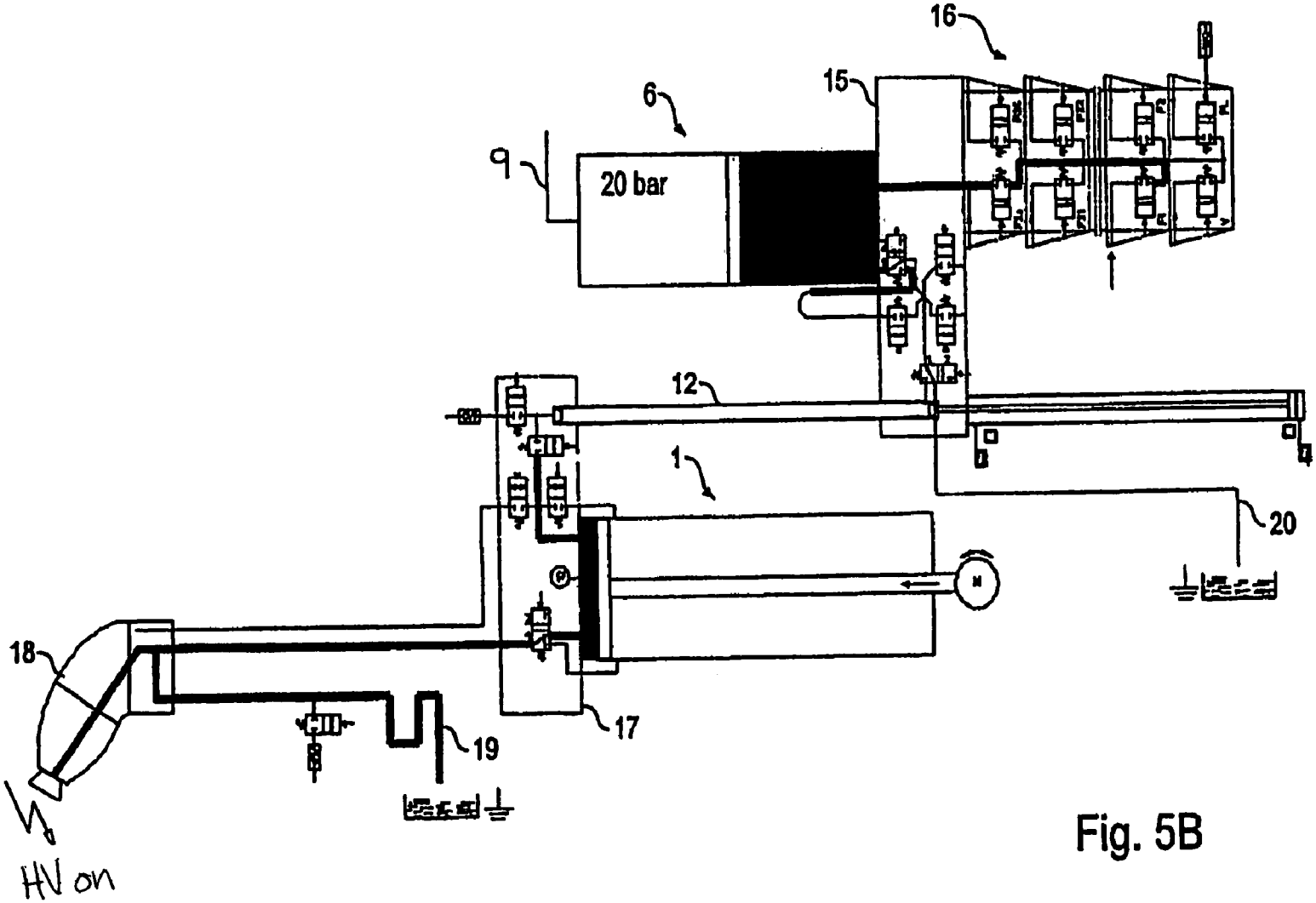

Through the color changer 16 and the valve array 15, the coating means reservoir 6 is filled with the new coating means during the painting process using a higher pressure of, for example, 20 bars. When painting with the old color is complete, the high-voltage potential at the rotational atomizer 18 and the coating means meter 1 is switched off, and the old color remaining in the coating means meter 1 is pushed out through the return line 19. This is shown in FIG. 5B.

Figure 5C:
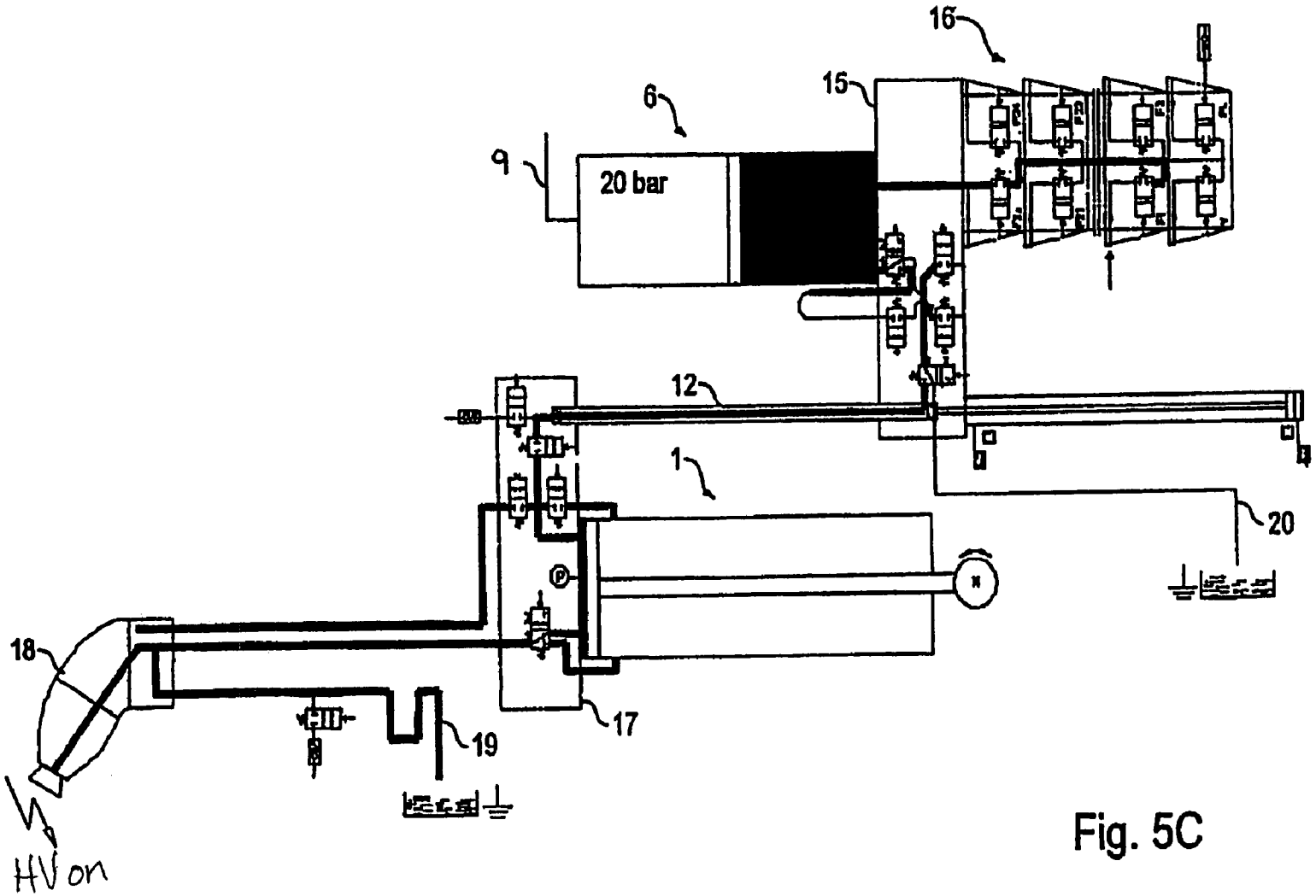

After the old paint remaining in the coating means meter 1 is pushed out, the coating means meter 1 is purged together with the rotational atomizer 18 and the insulating hose 12, which is shown in FIG. 5C.

Figure 5D:
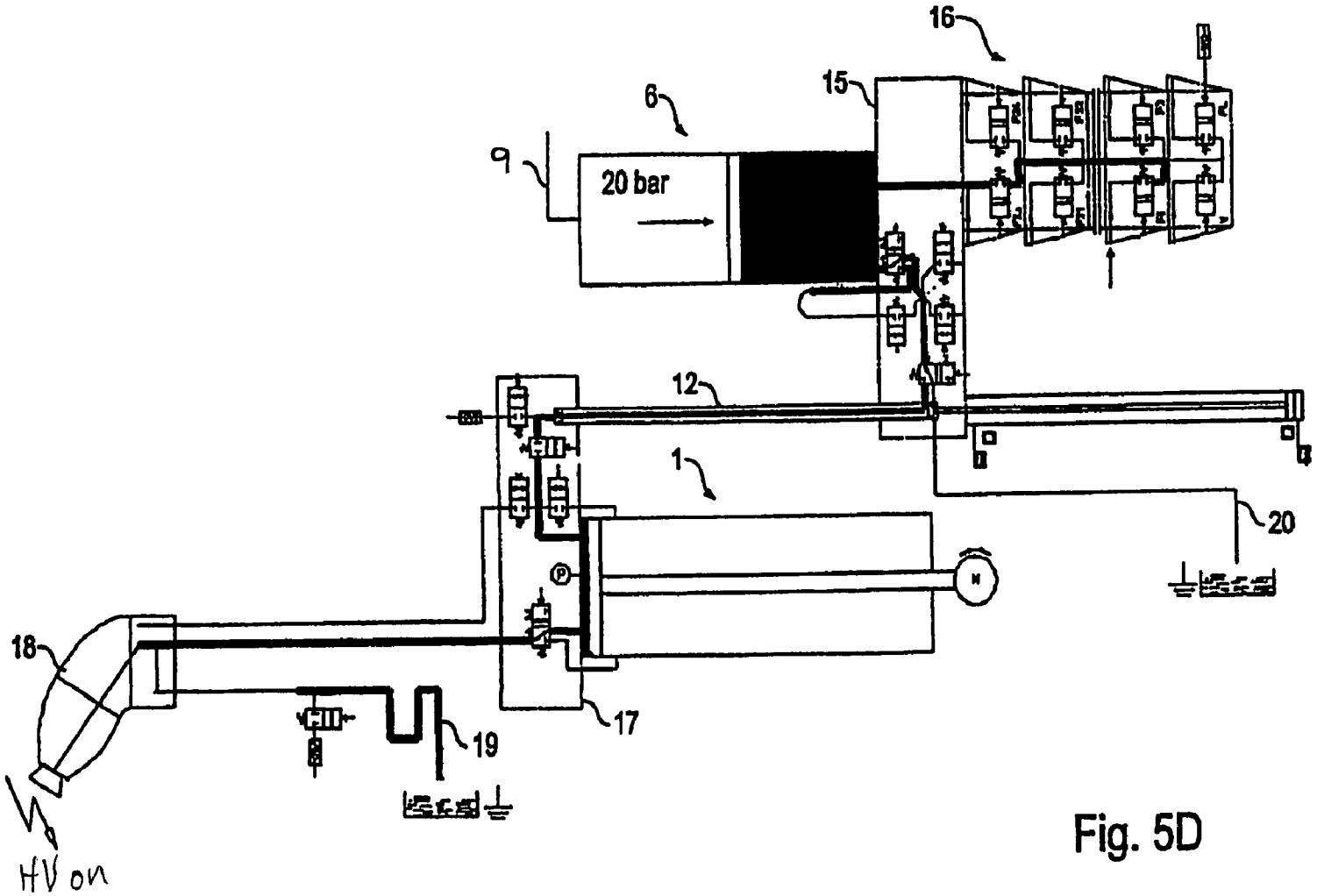

In the next phase in accordance with FIG. 5D, the valve array 15 opens the connection between the coating means reservoir 6 and the coating means meter 1 so that the new color is soft pushed to the coating means meter 1 and the main line.

Figure 5E:
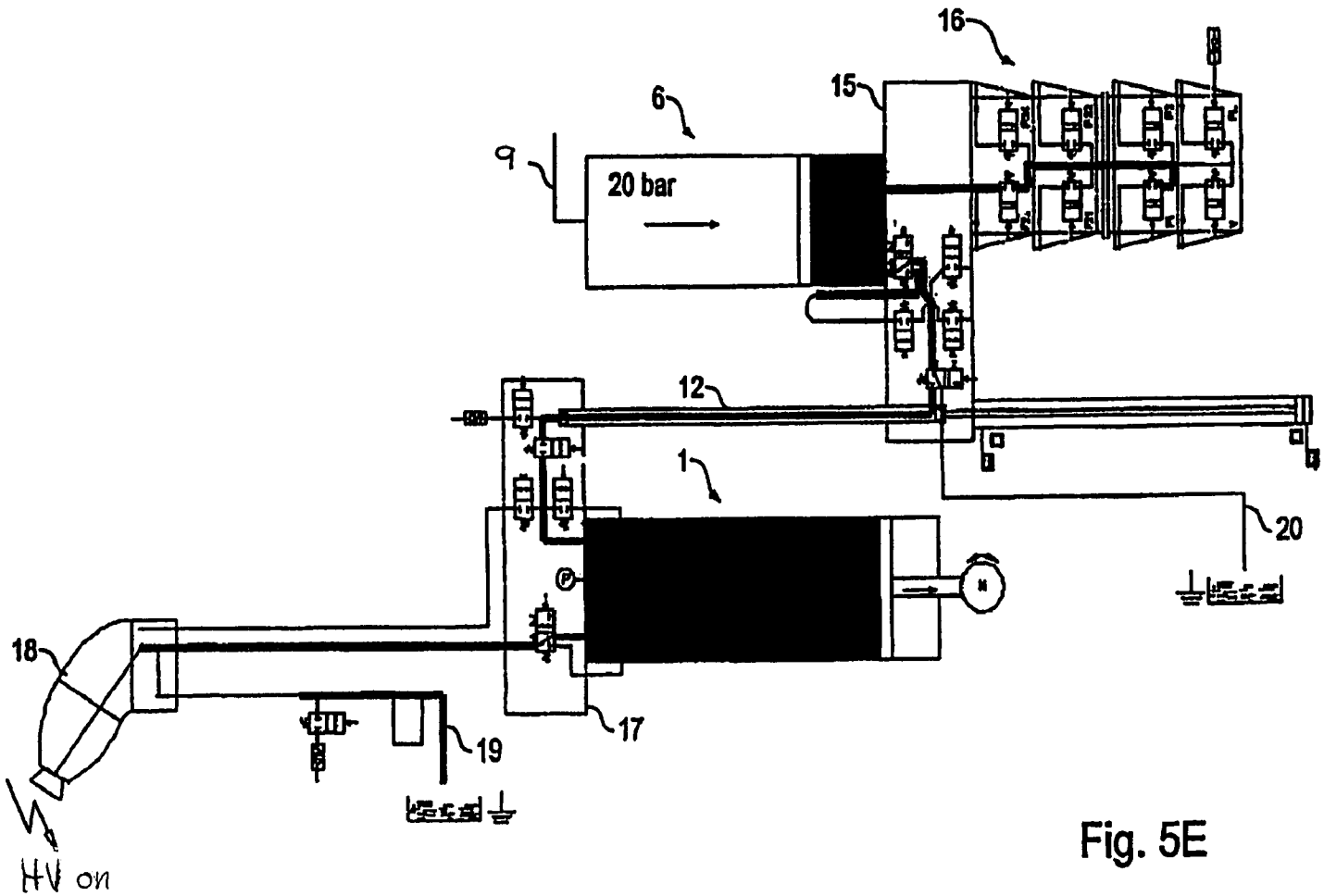

Then, in the operating phase shown in FIG. 5E, the coating means meter 1 is filled with the new color from the coating means reservoir 6 through the insulating hose 12 and the valve array 17.

Figure 5F:
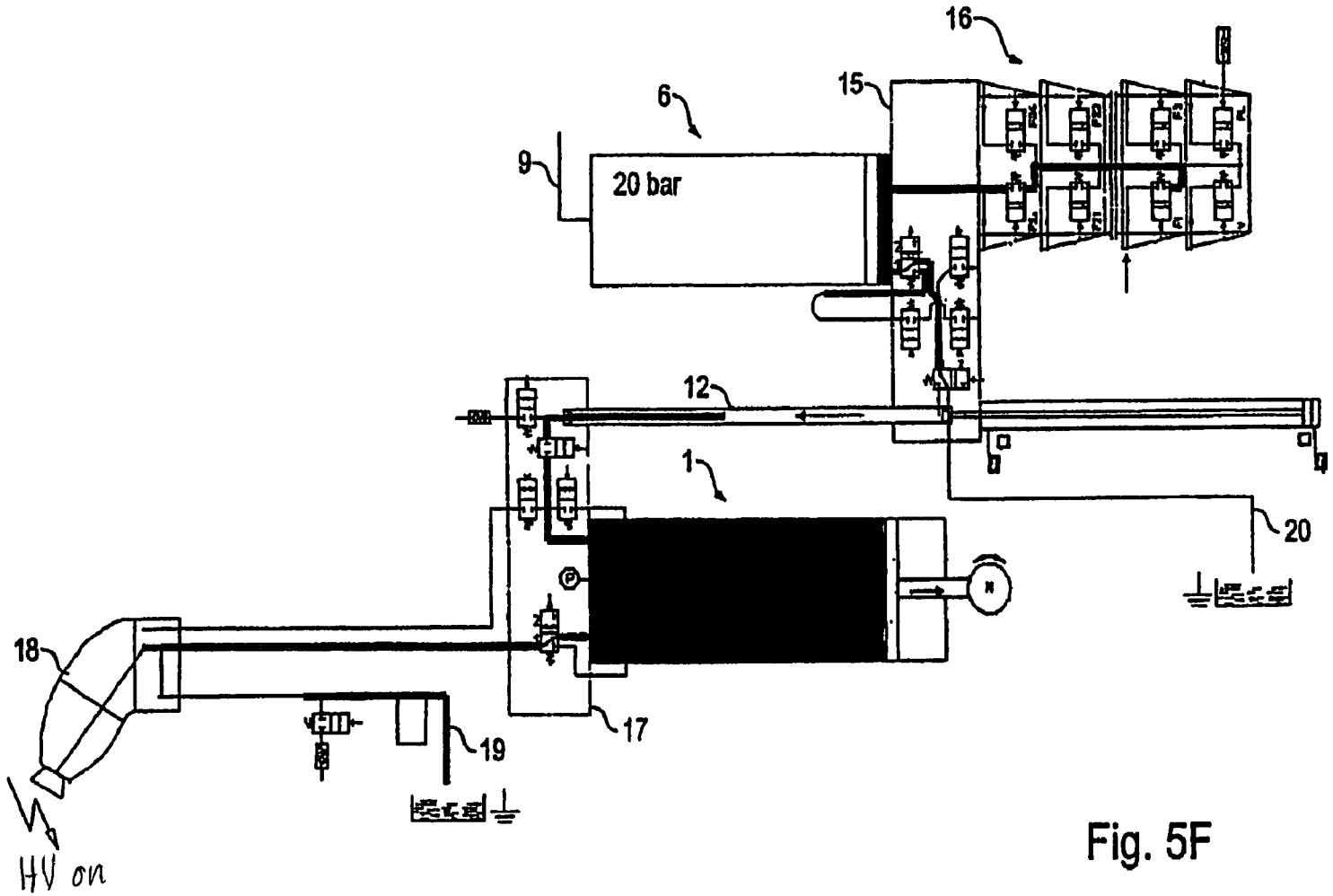

After the coating means meter 1 has been filled, the color still present in the insulating hose 12 is then taken into the coating means meter 1, which is shown in FIG. 5F. This emptying of the insulating hose 12 is important so that the insulating hose 12 can subsequently electrically insulate the coating means meter 1 under high-voltage potential from the coating means reservoir 6 during the painting operation.

Figure 5G:
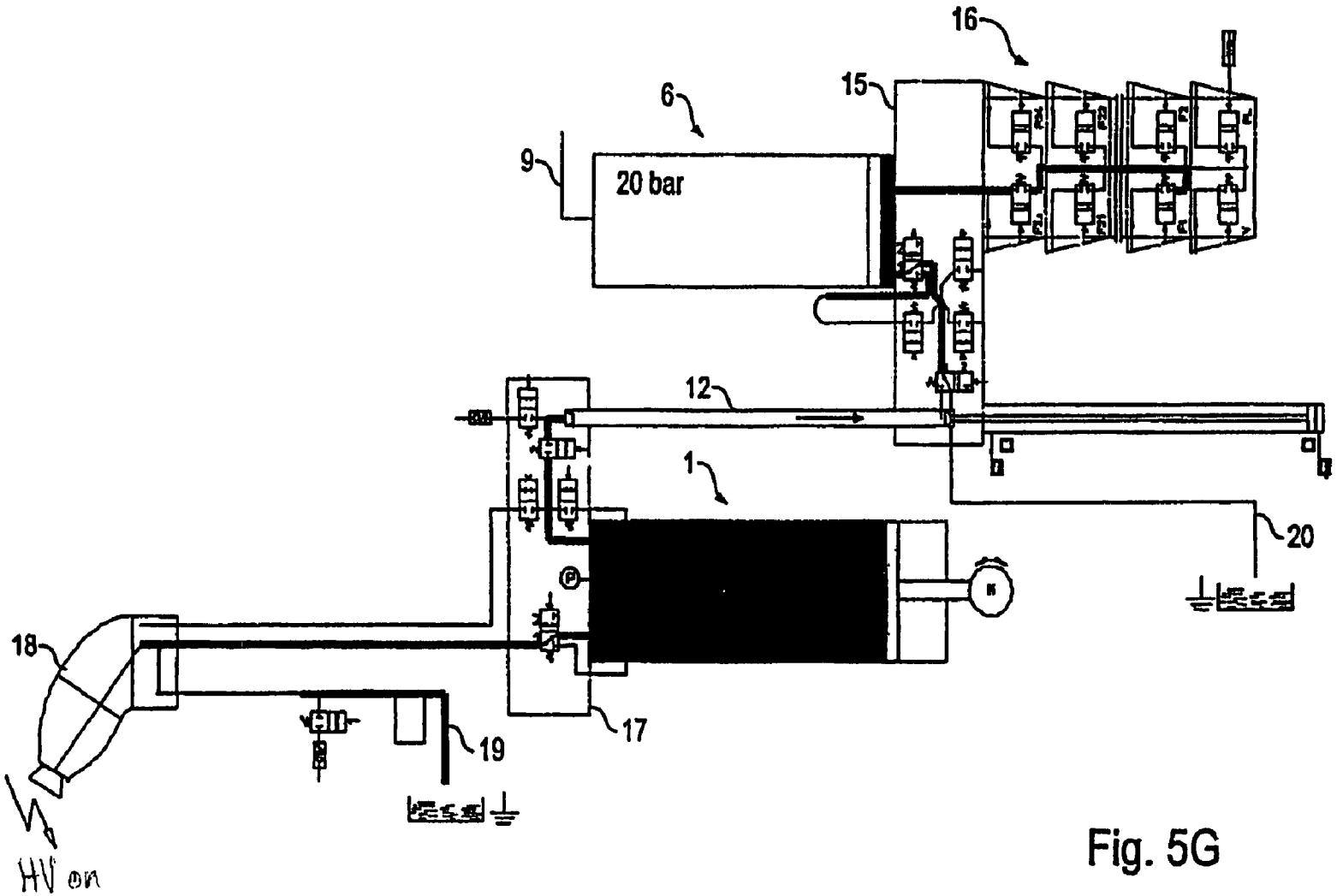

After the emptying of the insulating hose 12, in the phase shown in FIG. 5G the high-voltage for the rotational atomizer 18 and the coating means meter 1 is switched on, where the insulating hose 12 then electrically insulates the coating means meter 12 from the coating means reservoir 6.

Figure 5H:
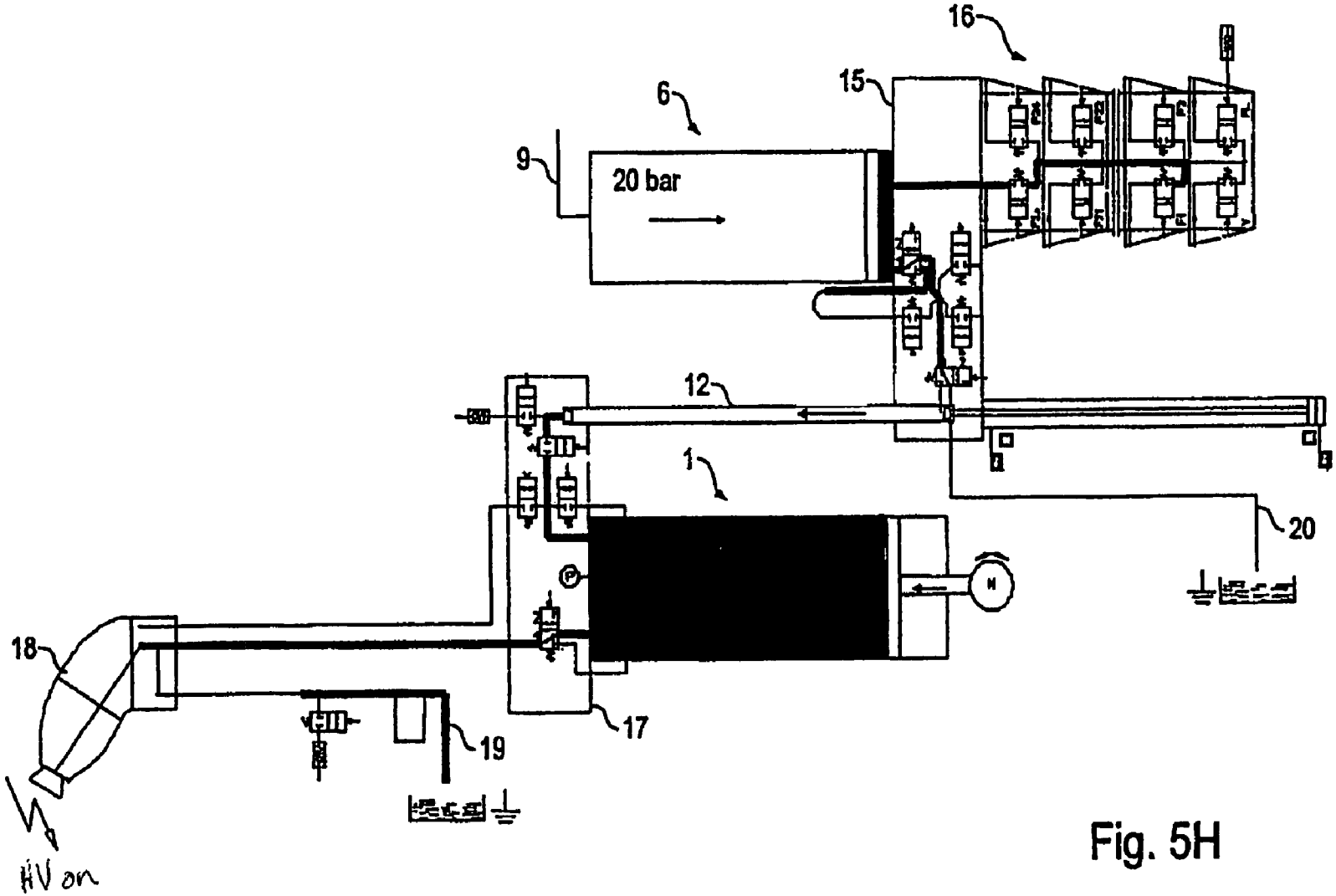

In the next phase of operation shown in FIG. 5H, the new color is soft pushed to the main needle of the rotational atomizer 18 and the painting process begins,.

Figure 5I:
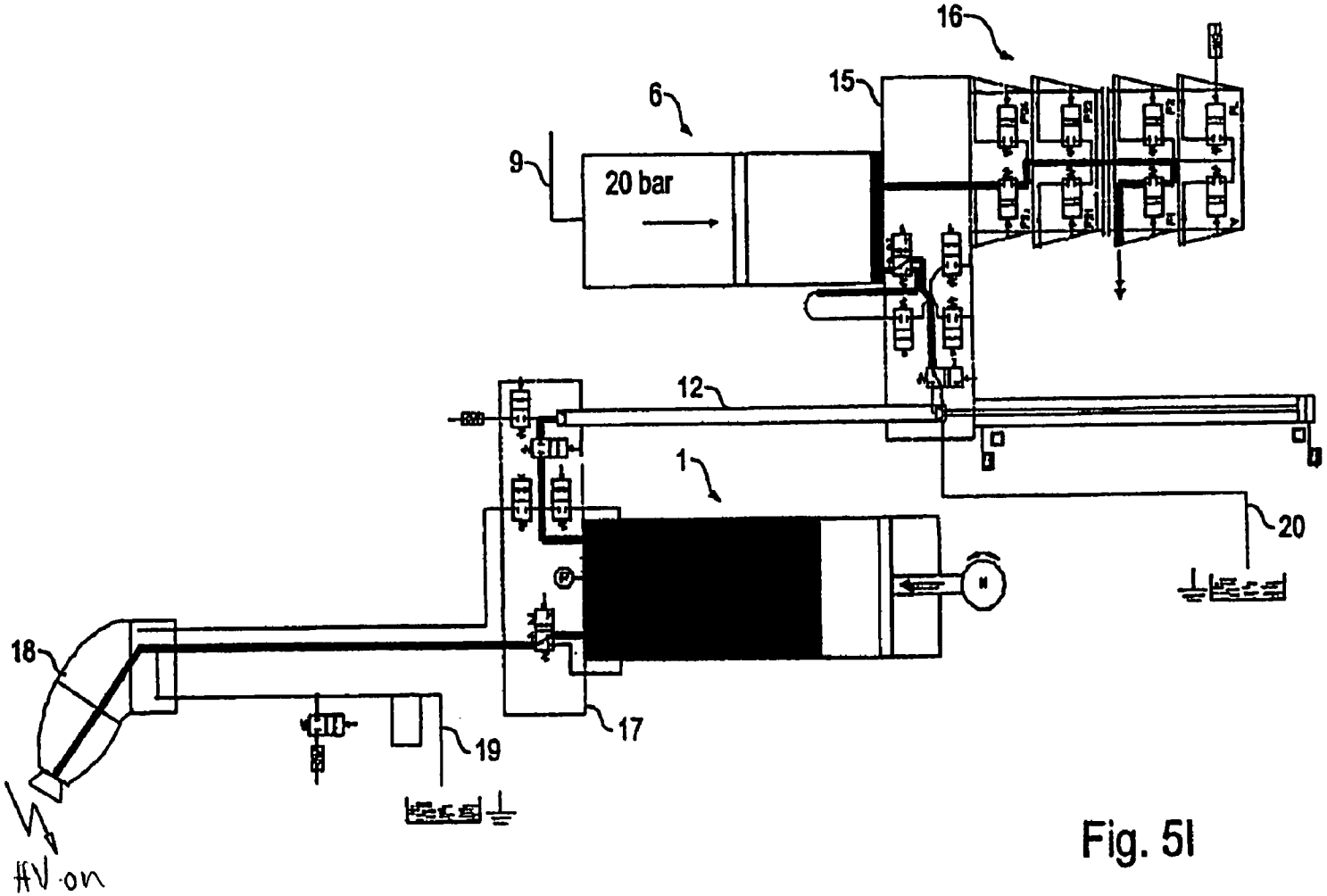

In the phase of operation shown in FIG. 5I, the new color remaining in the coating means reservoir 6 is pushed through the valve array 15 and the color changer 16 back into the coating means supply line 11, which is also described as "reflow."

Figure 5J:
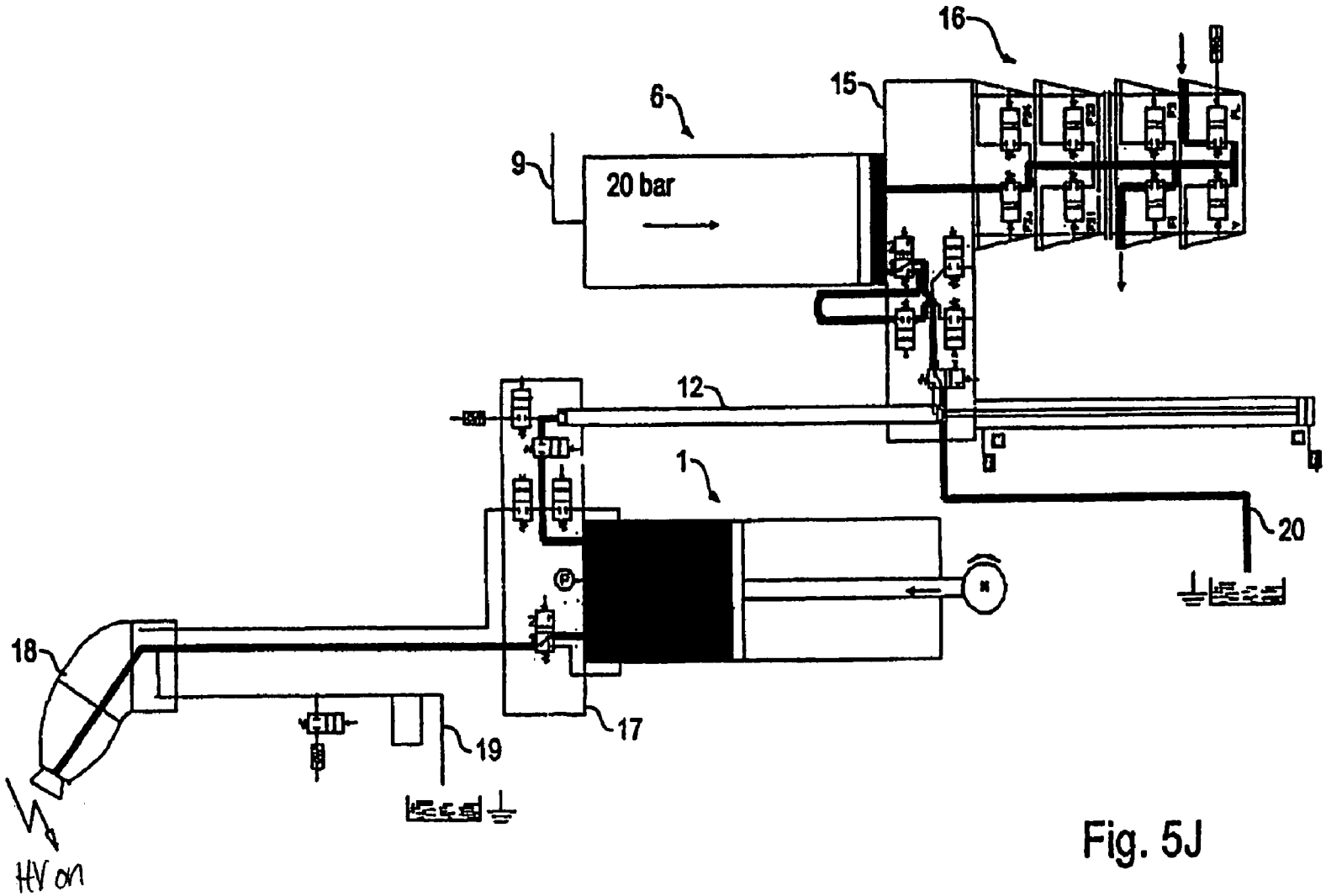

In the final operating phase of a color change in accordance with FIG. 5J, the coating means reservoir 6 is purged together with the valve array 15 and the color changer 16 to allow subsequent filling with a new color without contamination by color remnants.

Figure 7:
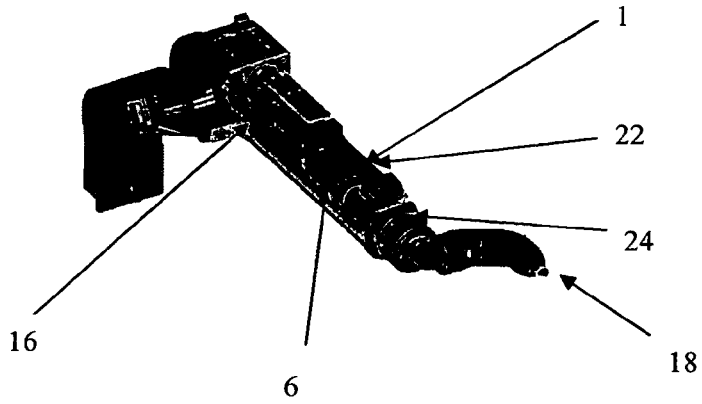
FIG. 7 shows a painting robot system incorporating a robot with two arms with an embodiment of the invention where the coating means reservoir and the coating means meter are both on a second robot arm.

FIG. 7 shows an embodiment of the invention with a painting robot system incorporating a robot with two arms (including a second arm 22) and a wrist 24. In the embodiment shown in FIG. 7 the second arm 22 holds the coating means reservoir 6, the coating means meter 1 and the color changer 16. The wrist 24 holds the rotational atomizer 18.

Figure 8:
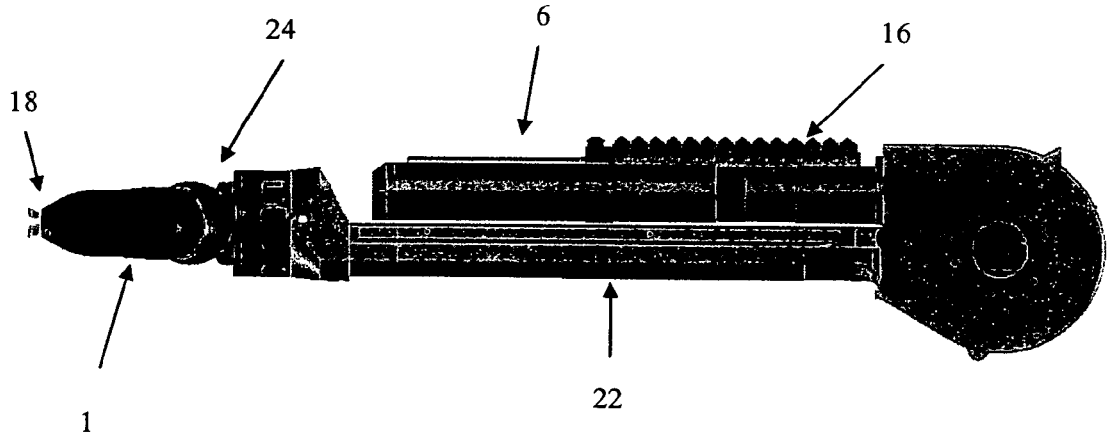
FIG. 8 shows a painting robot system incorporating a robot with two arms and a wrist with an embodiment of the invention where the coating means reservoir is on a second robot arm and the coating means meter is on a wrist.

FIG. 8 shows another embodiment of the invention with a painting robot system incorporating a robot with two arms (including a second arm 22) and a wrist 24. In the embodiment shown in FIG. 8 the second arm 22 holds the coating means reservoir 6 and the color changer 16. The wrist 24 holds the coating means meter 1 and the rotational atomizer 18.

The invention is not restricted to the previously described preferred embodiments. A plurality of variants and modifications are possible which similarly make use of the inventive idea and therefore fall under the scope of its protection.

What is claimed is:

1. A coating means supply device for supplying coating means or application on an object, the device comprising:

a coating means meter for metering the coating means;

a coating means reservoir for holding the coating means and for supplying the coating means to the coating means meter, wherein the coating means reservoir is located upstream from the coating means meter and is connected on an output side to the coating means meter;

a high-voltage potential coupled to the coating means meter when the coating means reservoir is at a ground potential; and an insulating path coupling the coating means reservoir to the coating means meter, the insulating path configured to receive a movable element for cleaning the insulating path;

wherein the coating means reservoir, the insulating path, and the coating means meter are each located in components of a single painting robot, the components including a wrist of the painting robot and an arm of the painting robot.

2. The device according to claim 1, wherein the coating means meter is coupled to the high-voltage potential, and further comprising a docking interface configured to allow selective coupling of the coating means reservoir to the high-voltage potential, wherein the coating means reservoir is selectively movable between a first position wherein the coating means reservoir is coupled to the high-voltage potential, and a second position wherein the coating means reservoir is coupled to the ground potential.

3. The device according to claim 2, further comprising:

a docking interface connected to the coating means meter and separably joining the coating means meter to the coating means reservoir.

4. The device according to claim 1 wherein the coating means reservoir has an adjustable storage capacity defined by a position of a piston.

5. The device according to claim 4 wherein the piston of the coating means reservoir is operable using compressed air.

6. The device according to claim 1 wherein the coating means meter is a piston meter including a cylinder and a metering piston movable in the cylinder.

7. The device according to claim 6 wherein the coating means reservoir is located in the cylinder on a side of the metering piston, the device further comprising:

a storage piston movable in the cylinder, a storage capacity of the coating means reservoir defined by the storage piston position.

8. The device according to claim 7 wherein the cylinder has a dividing wall separating the coating means meter from the coating means reservoir.

9. The device according to claim 1 wherein the coating means meter and the coating means reservoir are located in a single arm of a painting robot.

10. The device according to claim 1 wherein the coating means reservoir is located in an arm of a painting robot and the coating means meter is located in a wrist of the painting robot.

* * * * *